US006108429A

United States Patent [19]

Nakamura et al.

[11] Patent Number: 6,108,429

[45] **Date of Patent: *Aug. 22, 2000**

[54] SPEAKER ADAPTED FOR USE AS A CENTER WOOFER IN 3-DIMENSIONAL SOUND SYSTEM

[75] Inventors: Takeshi Nakamura, Uji; Yoshiaki Heinouchi, Jouyou, both of Japan

[73] Assignee: Murata Manufacturing Co., Ltd., Japan

[ * ] Notice: This patent is subject to a terminal disclaimer.

[21] Appl. No.: 09/050,542

[22] Filed: Mar. 30, 1998

Related U.S. Application Data

[63] Continuation-in-part of application No. 08/867,288, Jun. 2, 1997.

[30] Foreign Application Priority Data

Apr. 15, 1997 [JP] Japan ..... 9-097665
Feb. 26, 1998 [JP] Japan ..... 10-045634

[51] Int. Cl.[7] ..... H04R 25/00

[52] U.S. Cl. ..... 381/152; 381/173; 381/190; 381/353

[58] Field of Search ..... 381/190, 191, 381/173, 353, 354, 324, 800, 152

[56] References Cited

U.S. PATENT DOCUMENTS 4,951,677 8/1990 Crowley et al. ..... 128/662.06
5,059,851 10/1991 Corl et al. ..... 310/334
5,115,814 5/1992 Griffith et al. ..... 128/662.06
5,313,949 5/1994 Yock ..... 128/662.06
5,353,798 10/1994 Sieben ..... 128/662.06

FOREIGN PATENT DOCUMENTS 0 640 564 A1 8/1993 European Pat. Off. ..... 33/158
09224299A 2/1996 Japan ..... H04R 17/00

OTHER PUBLICATIONS

"Jet Propulsion Laboratory," Dr. Peter Tsou, (NASA Tech Briefs, The Digest of New Technology, May 1995, vol. 19, No. 5).

*Primary Examiner*—Wing F. Chan
*Assistant Examiner*—Dionne N. Harvey
*Attorney, Agent, or Firm*—Graham & James LLP

[57] ABSTRACT

A speaker has a substantially reduced overall size while producing a complete low frequency sound range at high output amplitude. The speaker includes a main body having open sections at both ends thereof. A sounding body pinched by ringed first dampers is secured to each of the open sections of the main body so that the inside of the main body is kept air-tight except for one opening. A first opening is provided at the middle part of the side of the main body. Lid members are secured on the outside of the two sounding bodies via a ringed second damper so as to keep the inside of the lid member air-tight. A second opening is created around the middle of the bottom of each of the lid members.

20 Claims, 2 Drawing Sheets

SPEAKER ADAPTED FOR USE AS A CENTER WOOFER IN 3-DIMENSIONAL SOUND SYSTEM

This Application is a Continuation-In-Part of U.S. patent application Ser. No. 08/867,288, filed Jun. 2, 1997 currently pending.

BACKGROUND OF THE INVENTION

1. Field of the Invention

The present invention relates to a speaker and more particularly to a speaker which is adapted for use as a center woofer in a 3-Dimensional ("3D") sound system such as a stereo.

2. Description of the Related Art

A 3D sound system such as a stereo produces a low frequency sound range of about 100 to 150 Hz or less to provide a 3D sound effect. Such low frequency sound is usually produced by one speaker functioning as a woofer. This one speaker for reproducing the low frequency sound usually includes a first sounding body for generating sound in accordance with a left channel signal and a second sounding body for generating sound in accordance with a right channel signal.

FIG. 3 shows a conventional speaker which functions as a woofer for generating a signal in which both right and left channels of the low frequency sound range of about 100 to 150 Hz or less are combined.

The speaker 6 includes a main body 1, a partition 2 provided within the main body 1, two sounding bodies 3 and 4 attached to the partition 2 and a duct 5 provided at the lower part of the front surface of the main body 1. The sounding bodies 3 and 4 are attached to the main body 1 such that the sounding bodies are arranged to transmit sound toward and through the duct 5. Although not shown specifically in FIG. 3, a sound in the low sound range of the right and left channels of less than 100 to 150 Hz is output when a signal of the left channel is input to the sounding body 3 and a signal of the right channel is input to the sounding body 4.

At this time, the sounds emitted directly from the sounding bodies 3 and 4 are not emitted to the outside of the main body 1. Only sounds having a frequency which is equal to a resonant frequency of the duct 5 and the main body 1 are emitted to the outside of the main body 1.

However, because a sounding body, e.g. a cone plate, which allows a large amplitude sound to be obtained is used in the prior art speaker described above in order to obtain a large output in the low sound range, the overall size of the speaker must be very large.

It is possible to form the sounding body to comprise a plate-like piezoelectric element to reduce the size of the speaker and eliminate the size problem. However, when such a piezoelectric element is used as the sounding body in the prior art speaker described above, the output in the low sound range is insufficient because the amplitude of sound generated by the piezoelectric element is small as compared to the amplitude of the sounding body comprising the cone plate.

An overall area or size of the piezoelectric element may be increased to increase the amplitude of the piezoelectric element. However, such a solution inevitably and significantly increases the necessary overall size of the speaker.

Further, because the low frequency sound output by the conventional speaker in FIG. 3 depends on a resonance frequency existing between the duct and the main body and there is only one resonance frequency in the prior art speaker, a sufficiently low sound output level can not be obtained for a low sound range which has a frequency that is different from the resonance frequency of the conventional speaker. Therefore the sound output by the conventional speaker is insufficient in the entire lower frequency range.

SUMMARY OF THE INVENTION

To overcome the problems described above, the preferred embodiments of the present invention provide a speaker which has a significantly reduced size compared with the prior art speaker and achieves a significantly increased sound output in the entire spectrum of frequencies in a low frequency sound range.

According to one preferred embodiment of the present invention, a speaker includes a main body having open sections at the both ends thereof; two sounding bodies which are provided at open sections at the both ends of the main body and which are vibrated by electrical signals; two lid members provided so as to cover the two sounding bodies; and a first opening provided at the side portion of the main body and a second opening provided at the bottom portion of the lid members, wherein the two sounding bodies are driven in the direction in which internal pressure of the main body and internal pressure of the lid member are increased/decreased. The speaker is arranged and constructed such that a resonance frequency within the main body is differentiated from a resonance frequency within spaces defined between each of the two lid members and the main body.

The main body and the lid members are preferably substantially cylindrical. However, the main body, the lid members and the overall speaker may be made to have any shape. The piezoelectric body made of ceramic is preferably used for at least one of the sounding bodies.

Furthermore the speaker includes a first input terminal for inputting one channel signal of a stereo signal and which is connected to a first one of the sounding bodies. The speaker also includes a second input terminal for inputting another channel signal of the stereo signal and which is connected to the a second one of the sounding bodies.

Because the plurality of resonance frequencies in the low sound frequency range exists in the speaker of the preferred embodiments of the present invention, the range of frequency of the low frequency is widened and the low sound level generated by the speaker is significantly increased in the widened low frequency sound range.

When an electrical signal is input to the two sounding bodies so that the internal pressure of the main body is increased/decreased by the two sounding bodies, sound waves are generated within the main body from the two sounding bodies and are emitted to the outside of the speaker from the first opening of the main body. Because a diameter of the first opening is smaller than the sounding body, the amplitude of the sound waves emitted from the first opening becomes larger than the amplitude of the sound waves generated from the sounding body. Therefore, the speaker of the preferred embodiments of the present invention achieves not only the miniaturization of the speaker because of the use of the plate-like piezoelectric body which is smaller and thinner than the sounding body utilizing a cone plate used in the prior art speaker, but also the speaker functioning as a woofer fully generates the entire frequency range of the low frequency sound level.

Further, the speaker of the preferred embodiments of the present invention is adapted to be used as a 3-D center channel woofer and to generate a full low frequency sound range while having a very simple structure and low cost. Such results are achieved because an acoustic low-pass filter is constructed and defined by attaching the two sounding bodies on the one main body, by generating sound which is a combined output of the right channel signal and the left channel signal and by utilizing only sound pressure from the openings provided on the main body and the lid member.

These and other elements, features, and advantages of the preferred embodiments of the present invention will be apparent from the following detailed description of the preferred embodiments of the present invention, illustrate in the accompanying drawings.

DETAILED DESCRIPTION OF PREFERRED EMBODIMENTS

Figure 1:
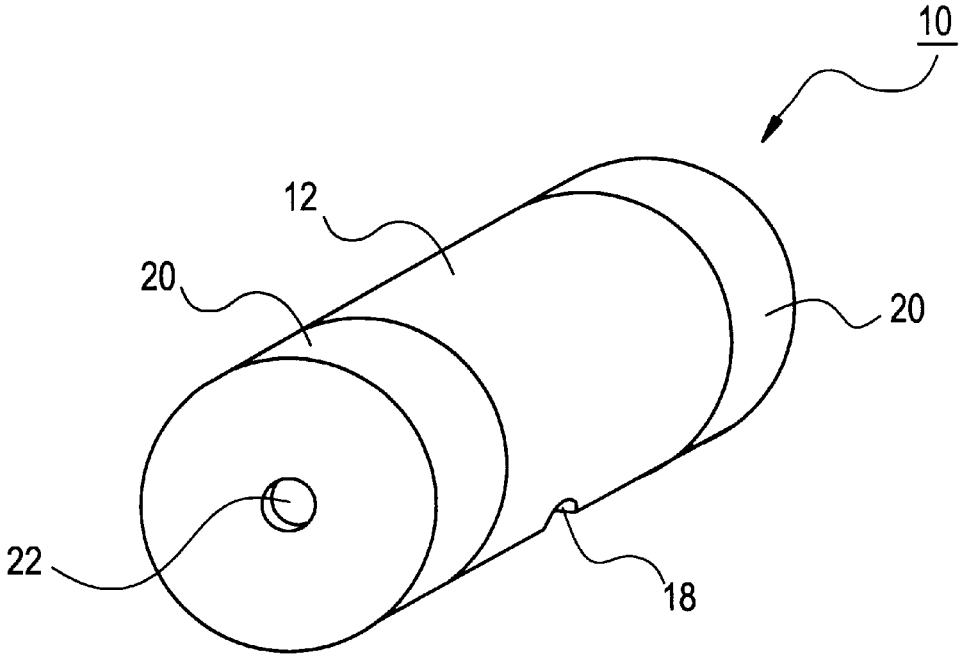
FIG. 1 is a perspective view showing a structure of a speaker according to a preferred embodiment of the present invention.
Figure 3:
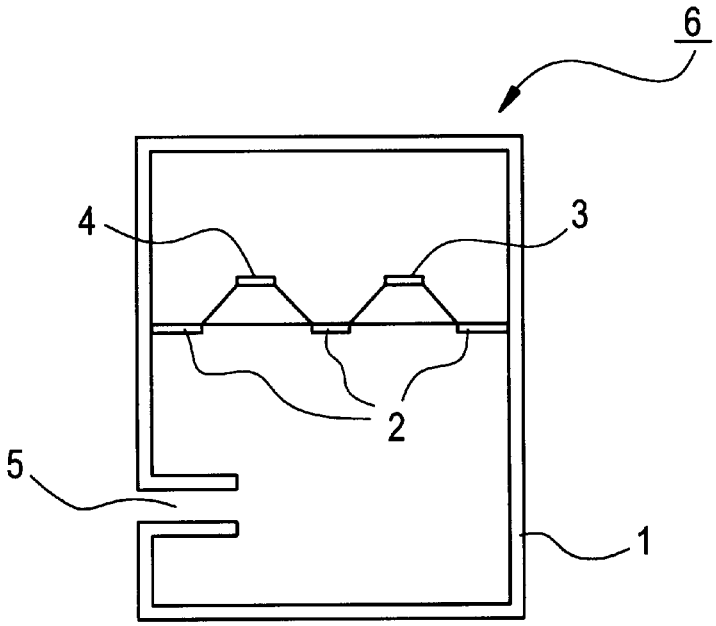
FIG. 3 is an explanatory diagram showing a structure of a prior art speaker.
Figure 2:
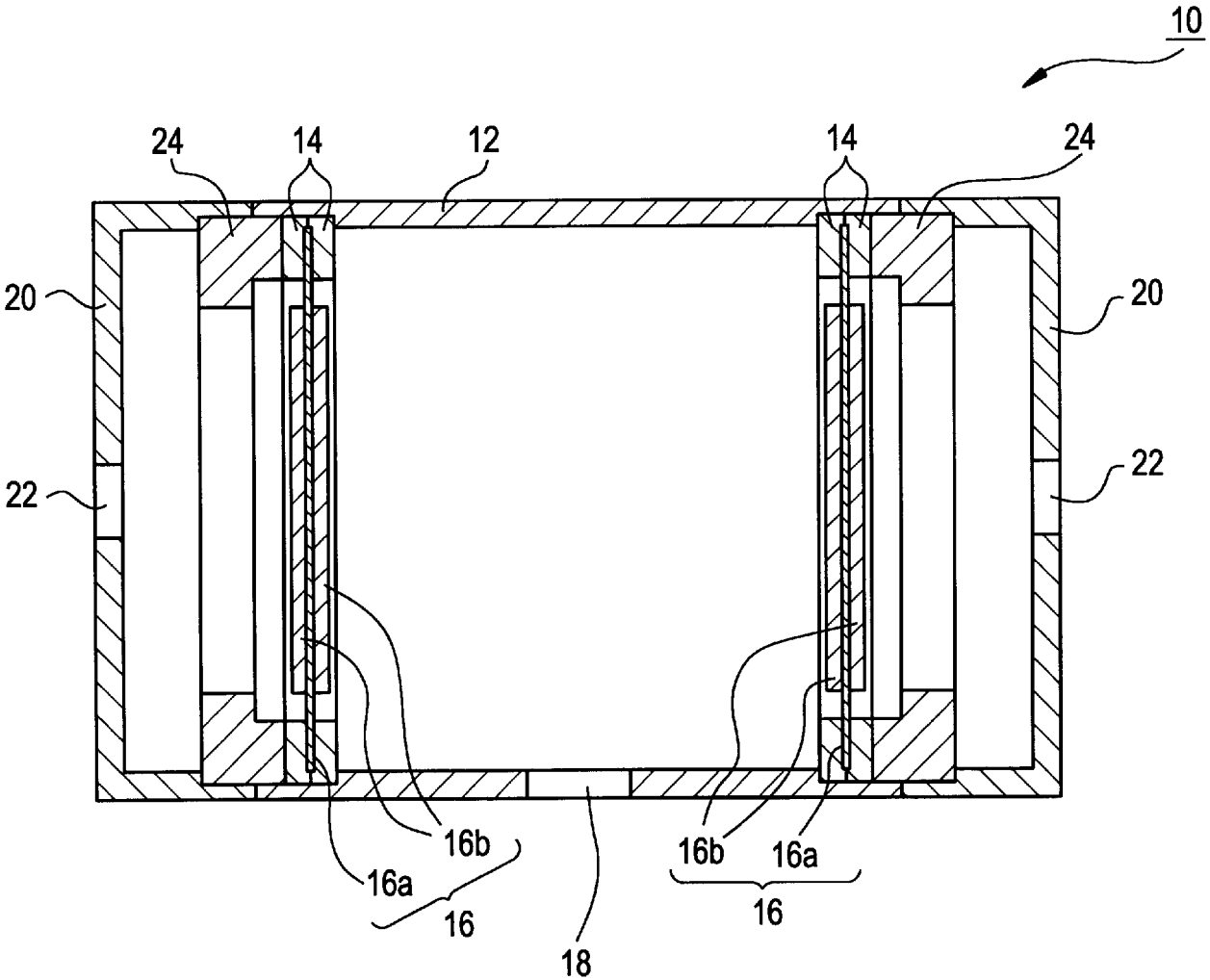
FIG. 2 is a section view showing the structure of the speaker according to the preferred embodiment shown in FIG. 1.

FIGS. 1 and 2 show a speaker according to a preferred embodiment of the present invention. A speaker 10 includes a main body 12 which is substantially cylindrical but can be any shape. Both ends of the main body 12 constitute open sections and ringed first dampers 14 are provided at the respective open sections. A sounding body 16 is provided at the first damper 14 and another first damper 14 is provided on the outside of the sounding body 16. That is, the sounding body 16 is secured to the main body 12 so that the inside of the main body 12 is kept air-tight at all areas therein except for an opening 18 (described below) while being pinched by the two first dampers 14.

Then, a first opening 18, preferably substantially circular but can have any shape, is created at a substantially middle portion of the side of the main body 12. Further, ringed second dampers 24 are provided on the first dampers 14 on the outside of the two sounding bodies 16. A lid member 20 is provided over the second damper 24. The lid member 20 is preferably substantially cylindrical or having substantially the same shape as the main body. The lid member 20 is secured so as to cover the open section of the main body 12 and to keep the inner portion of the lid member 20 air-tight at all areas therein except for an opening 22. A second opening 22, preferably circular but can be any shape, is created around substantially the middle of the bottom of the lid member 20.

It is preferred that the main body 12 and the lid member 20 are made of a synthetic resin material such as plastic or a wood cut out into the cylindrical shape. Other suitable materials and shapes may also be used for forming the main body 12 and the lid member 20.

The sounding body 16 also includes a disc-like vibrating plate 16*a* made of metal for example and disc-like piezoelectric elements 16*b* are secured preferably at substantially the middle portion of both main surfaces of the vibrating plate 16*a* on a concentric circle of the vibrating plate 16*a* respectively as a vibration source arranged to have a bimorph structure. Although not shown specifically, the piezoelectric element 16*b* is preferably fabricated by forming electrode films on both main surfaces of the disc-like piezoelectric body 16.

Preferably, the first damper 14 and the second damper 24 are made of a material having a high mass and a high sealability property.

Furthermore, although not shown specifically, the speaker 10 is preferably placed on a supporting member (not shown) so that the first opening 18 of the main body 10 faces downwardly toward the supporting member.

One of the two sounding bodies 16 is connected to one input terminal (not shown) provided on the outside of the main body 12 preferably via a lead wire (not shown) and the other of the two sounding bodies 16 is connected to another input terminal (not shown) provided on the outside of the main body 12 preferably via another lead wire (not shown).

When an electrical signal is input from an amplifier (not shown) to one of the input terminal, one of the sounding bodies 16 vibrates and when an electrical signal from the amplifier (not shown) is input to the other input terminal, the other of the sounding bodies 16 vibrates.

Then, the sounding bodies 16 are driven so that the internal pressure of the main body 12 is increased/decreased at the same time by the two sounding bodies 16 in the speaker 10. That is, when one channel signal, e.g. a right channel signal, of a stereo signal is input to one input terminal, the other channel signal, i.e. a left channel signal, of the stereo signal is input to the other input terminal.

By inputting signals as described above, sound waves are generated within the main body 12 from the two sounding bodies 16 and resonance occurs between the main body 12 and the first opening 18. Only sound waves having a frequency which is equal to the resonance occurring between the main body 12 and the opening 18 are emitted to the outside of the main body 12 from the first opening 18.

Consequently, sound waves in the low frequency sound range having no phase difference between the right channel signal and the left channel signal are emitted to the outside of the main body 12. The sound waves thus generated have double pressure and in the right channel signal and the left channel signal are synthesized and greatly increased, clearly sufficient sound pressure may be obtained even if the size of the main body 12 is small, so that the speaker 10 achieves sound generation of loan entire range of low frequency sounds while having a very small, greatly reduced overall size of the speaker.

It is noted that the middle/high sound range having a phase difference between the right channel signal and the left channel signal is canceled in this speaker because the right channel signal and the left channel signal are combined, so that the low sound range of the emitted sound is increased and amplified further.

Sound waves is generated also within an interior portion of the lid members 20 from the two sounding bodies 16 and resonance occurs between each of the lid members 20 and each of the respective second openings 22. Only a generated sound which is magnified by the resonance is emitted to the outside of the lid members 20 from the second openings 22.

A resonance frequency may be expressed by the following equation from the law of Helmholtz: Equation 1

$$f = \frac{c}{2\Pi}\sqrt{\frac{\Pi r^{2l}}{v(1+1.3r)}}$$

Where, (f) denotes a resonance frequency, (c) a speed of sound, (V) a volume of a resonator, (l) a thickness of the resonator and (r) a radius of an opening.

Then, in the speaker 10, when a resonance frequency in the main body 12 is $f_{12}$ and a resonance frequency in the lid member 20 is $f_{18}$, the range of the low frequency sound is significantly widened and the low frequency sound level generated by the speaker 10 is improved in the widened low frequency sound range when the speaker 10 is constructed so that $f_{12} \neq f_{18}$ (*). * by increasing the volume of the main body 12 more than that of the lid member 20 for example.

Further, although not shown specifically, sound absorbers made of glass wool may be provided within the main body 12 and the lid member 20. Because such sound absorbers absorb and damp the middle/high frequency range of the sound waves generated within the main body 12 and the lid member 20, the low frequency range of the generated sound wave is magnified further.

When an electrical signal is input to the two sounding bodies 16 so that the internal pressure of the main body 12 is increased/decreased by the two sounding bodies 16 in the speaker 10 of the preferred embodiments of the present invention, sound waves are generated within the main body 12 from the sounding bodies 16 and are emitted to the outside from the first opening 18 of the main body 12. At this time, because a diameter of the first opening 18 is set to be smaller than the sounding body 16, the amplitude of the sound waves emitted from the first opening 18 is larger than the amplitude of the sound waves generated from the sounding body 16.

Therefore, the speaker 10 achieves not only the miniaturization of its overall size because it uses the plate-like piezoelectric body as the sounding body which is smaller and thinner than a sounding body utilizing a cone plate used in the prior art speaker, but also the speaker 10 preferably functioning as a woofer fully generates an entire range of low frequency.

Further, the speaker 10 which allows the full low frequency sound range to be obtained completely by the simple structure and at low cost and also allows the speaker to function as center channel woofer for a 3D sound system such as a stereo because an acoustic low-pass filter is defined by attaching the two sounding bodies 16 on one main body 12, by generating sound which is a combined output of the right channel signal and the left channel signal and by utilizing only sound pressure from the openings provided on the main body 12 and the lid member 20.

It is noted that although the main body in the preferred embodiments shown in FIGS. 1 and 2 has a substantially cylindrical shape, the main body may be formed into any shape. In addition, the lid member may be formed to have any suitable shape.

Further, the vibrating plate and the piezoelectric elements composing the sounding bodies may be formed into any shape such as a square plate, for example. The vibrating plate may be formed of rubber, synthetic resin, metal or other suitable material.

The sounding bodies including the piezoelectric elements preferably have a bimorph structure. However, sounding bodies including a piezoelectric element having a unimorph structure or a sounding bodies using a piezoelectric element having a laminated structure made of ceramic and using three or more layers of laminated piezoelectric layers may be used.

As described above, according to the speaker of the preferred embodiments of the present invention, the speaker achieves a plurality of resonance frequencies in the low frequency sound range by differentiating the resonance frequency within the main body from the resonance frequencies within the inner portions between the main body and each of the two lid members so that the range of the low frequency sound is significantly widened and the amplitude of the low frequency sound generated by the speaker is significantly increased in the widened low frequency sound range.

Further, when an electrical signal is input to the two sounding bodies so that the internal pressure of the main body is increased/decreased by the two sounding bodies, sound waves are generated within the main body from the two sounding bodies and are emitted to the outside from the first opening of the main body. At this time, because a diameter of the first opening is smaller than the sounding body, the amplitude of the sound waves emitted from the first opening are larger than the amplitude of the sound wave generated from the sounding body. Therefore, the speaker according to preferred embodiments of the present invention achieves miniaturization of the overall size of the speaker because it includes the plate-like piezoelectric body which is smaller and thinner than the sounding body consisting of a cone plate used in the prior art speaker, but also the speaker is constructed and arranged to generate a full range of low frequency sound with higher amplitude output because of the use and arrangement of the piezoelectric bodies, the main body and the lid members.

Further, the speaker of the preferred embodiments of the present invention achieves output of a compete low frequency sound range via a simple structure and at low cost and is adapted to be used as a center channel woofer for a 3D sound system. These advantages are achieved because an acoustic low-pass filter is defined by attaching the two sounding bodies on one main body, by generating sound that results from a combined output of the right channel signal and the left channel signal and by utilizing only sound pressure from the openings provided on the main body and the lid member.

While the invention has been particularly shown and described with reference to the preferred embodiments thereof, it will be understood by those skilled in the art that the foregoing and other changes in form and details may be made thereto without departing from the spirit and scope of the invention.

What is claimed is:

1. A speaker, comprising:

a main body having open sections at both ends thereof;

first and second sounding bodies each provided at a respective one of the open sections at both ends of said main body and which are vibrated by electrical signals;

first and second lid members arranged to cover a respective one of said two sounding bodies; and a first opening provided at a side portion of said main body and a second opening provided at a bottom portion of said lid member; wherein said first and second sounding bodies are arranged to be driven in a direction in which internal pressure of said main body and internal pressure of said lid members is increased/decreased; and a resonance frequency within said main body is differentiated from a resonance frequency within inner portions defined between said main body and each of said first and second lid members.

2. The speaker according to claim 1, wherein the first and second sounding bodies comprise a piezoelectric body made of ceramic.

3. The speaker according to claim 1, further comprising a first input terminal for inputting a first channel signal of a stereo signal connected to said first sounding body and a second input terminal for inputting a second channel signal of said stereo signal is connected to the second sounding body.

4. The speaker according to claim 1, wherein the first and second sounding bodies each comprise a piezoelectric body arranged to have a bimorph structure.

5. The speaker according to claim 1, wherein the first and second sounding bodies each comprise a piezoelectric body arranged to have a unimorph structure.

6. The speaker according to claim 1, wherein each of the first and second lid members comprise substantially cylindrical members.

7. The speaker according to claim 1, wherein the first opening provided at a side portion of said main body is substantially circular.

8. The speaker according to claim 1, wherein the second opening provided at a bottom portion of said lid member is substantially circular.

9. The speaker according to claim 1, wherein an acoustic low-pass filter is defined by the arrangement of the first and second sounding bodies and the first and second lid members on the one main body.

10. The speaker according to claim 2, wherein sound output from the speaker is a combined output of the right channel signal and the left channel signal.

11. The speaker according to claim 1, wherein the main body and the first and second lid members are arranged such that only sound pressure from the first opening provided in the main body and the second opening provided in the lid member is output from the speaker.

12. A speaker, comprising:

a main body having open sections at both ends thereof;

first and second sounding bodies each provided at a respective one of the open sections at both ends of said main body and which are vibrated by electrical signals; and first and second lid members arranged to cover a respective one of said two sounding bodies; wherein an acoustic low-pass filter is defined by the arrangement of the first and second sounding bodies and the first and second lid members on the one main body.

13. The speaker according to claim 12, further comprising a first opening provided at a side portion of said main body and a second opening provided at a bottom portion of said lid member.

14. The speaker according to claim 12, wherein said first and second sounding bodies are arranged to be driven in a direction in which internal pressure of said main body and internal pressure of said lid members is increased/decreased.

15. The speaker according to claim 12, wherein a resonance frequency within said main body is differentiated from a resonance frequency within inner portions defined between said main body and each of said first and second lid members.

16. The speaker according to claim 12, wherein the first and second sounding bodies comprise a piezoelectric body made of ceramic.

17. The speaker according to claim 12, further comprising a first input terminal for inputting a first channel signal of a stereo signal connected to said first sounding body and a second input terminal for inputting a second channel signal of said stereo signal is connected to the second sounding body.

18. A speaker, comprising:

a main body having open sections at both ends thereof;

first and second sounding bodies each provided at a respective one of the open sections at both ends of said main body and which are vibrated by electrical signals; and first and second lid members arranged to cover a respective one of said two sounding bodies; wherein a resonance frequency within the main body is differentiated from a resonance frequency within spaces defined between each of the two lid members and the main body.

19. The speaker according to claim 18, further comprising a first opening provided at a side portion of said main body and a second opening provided at a bottom portion of said lid member.

20. The speaker according to claim 18, further comprising a first input terminal for inputting a first channel signal of a stereo signal connected to said first sounding body and a second input terminal for inputting a second channel signal of said stereo signal is connected to the second sounding body.

* * * * *